US007785144B1

(12) United States Patent
Islam

(10) Patent No.: US 7,785,144 B1
(45) Date of Patent: Aug. 31, 2010

(54) CONNECTOR WITH POSITIVE STOP FOR COAXIAL CABLE AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 180 days.

(21) Appl. No.: 12/277,103

(22) Filed: Nov. 24, 2008

(51) Int. Cl.
*H01R 9/05* (2006.01)

(52) U.S. Cl. ..... 439/583

(58) Field of Classification Search ..... 439/583, 439/578, 584, 585, 586, 587, 271, 274, 275
See application file for complete search history.

(56) References Cited

U.S. PATENT DOCUMENTS

| | | | | |
|---|---|---|---|---|
| 3,040,288 A | | 6/1962 | Edlen et al. | 339/103 |
| 3,103,548 A | | 9/1963 | Concelman | 174/89 |
| 3,106,599 A | | 10/1963 | Leitner et al. | 174/12 |
| 3,671,926 A | | 6/1972 | Nepovim | 339/177 E |
| 3,744,011 A | | 7/1973 | Blanchenot | 339/177 R |
| 3,757,279 A | | 9/1973 | Winston | 339/177 R |
| 3,761,870 A | | 9/1973 | Drezin et al. | 339/177 R |
| 3,847,463 A | | 11/1974 | Hayward et al. | 339/8 P |
| 3,915,539 A | | 10/1975 | Collins | 339/94 C |
| 4,046,451 A | | 9/1977 | Juds et al. | 339/177 R |
| 4,491,685 A | | 1/1985 | Drew et al. | 174/75 C |
| 4,557,546 A | | 12/1985 | Dreyer | 339/177 R |
| 4,585,289 A | | 4/1986 | Bocher | 339/89 C |
| 4,676,577 A | | 6/1987 | Szegda | 439/584 |
| 4,915,651 A | * | 4/1990 | Bout | 439/578 |
| 4,923,412 A | | 5/1990 | Morris | 439/578 |
| 5,137,470 A | | 8/1992 | Doles | 439/578 |
| 5,154,636 A | | 10/1992 | Vaccaro et al. | 439/583 |
| 5,267,877 A | | 12/1993 | Scannelli et al. | 439/584 |
| 5,281,167 A | | 1/1994 | Le et al. | 439/578 |
| 5,352,127 A | | 10/1994 | Muller et al. | 439/188 |
| 5,352,134 A | | 10/1994 | Jacobsen et al. | 439/584 |
| 5,509,821 A | | 4/1996 | Small et al. | 439/272 |
| 5,545,059 A | | 8/1996 | Nelson | 439/583 |
| 5,576,675 A | | 11/1996 | Oldfield | 333/260 |
| 5,722,856 A | | 3/1998 | Fuchs et al. | 439/578 |
| 5,785,554 A | | 7/1998 | Ohshiro | 439/584 |
| 5,795,188 A | | 8/1998 | Harwath | 439/583 |
| 5,830,009 A | | 11/1998 | Tettinger | 439/578 |

(Continued)

OTHER PUBLICATIONS

Paynter, "Coupling Nut With Cable Jacket Retention," Jun. 29, 2008, pp. 1-20.

(Continued)

*Primary Examiner*—Chandrika Prasad
(74) *Attorney, Agent, or Firm*—Allen, Dyer, Doppelt, Milbrath & Gilchrist, P.A.

(57) ABSTRACT

A connector is to be attached to a coaxial cable including an inner conductor, an outer conductor, and a dielectric therebetween. The connector includes a connector housing defining a ramp to receive the outer conductor thereagainst and a back nut. A portion of the connector housing and the back nut includes respective portions defining a positive stop when fully engaged. An electrically conductive compressible coil spring is to compressibly clamp against the outer conductor opposite the ramp when the connector housing and back nut are engaged. The connector housing includes a rearward portion threadingly received with a forward portion of the back nut. A center contact is to be coupled to the inner conductor. An insulator member is in the connector housing for carrying the center contact.

24 Claims, 8 Drawing Sheets

U.S. PATENT DOCUMENTS

| | | | | |
|---|---|---|---|---|
| 5,938,474 | A * | 8/1999 | Nelson | 439/583 |
| 6,019,636 | A | 2/2000 | Langham | 439/584 |
| 6,109,964 | A | 8/2000 | Kooiman | 439/583 |
| 6,133,532 | A * | 10/2000 | Lundback et al. | 174/88 C |
| 6,148,513 | A | 11/2000 | Schiefer et al. | 29/858 |
| 6,203,368 | B1 | 3/2001 | Weidner | 439/579 |
| 6,267,621 | B1 | 7/2001 | Pitschi et al. | 439/584 |
| 6,309,250 | B1 | 10/2001 | Hyzin | 439/578 |
| 6,332,808 | B1 | 12/2001 | Kanda et al. | 439/584 |
| 6,386,915 | B1 | 5/2002 | Nelson | 439/584 |
| 6,396,367 | B1 | 5/2002 | Rosenberger | 333/260 |
| 6,439,924 | B1 * | 8/2002 | Kooiman | 439/578 |
| 6,462,637 | B1 | 10/2002 | Laverick | 336/107 |
| 6,607,398 | B2 | 8/2003 | Henningsen | 439/578 |
| 6,668,459 | B2 | 12/2003 | Henningsen | 30/90.2 |
| 6,692,300 | B2 | 2/2004 | Kanda et al. | 439/583 |
| 6,793,529 | B1 * | 9/2004 | Buenz | 439/583 |
| 6,802,739 | B2 | 10/2004 | Henningsen | 439/584 |
| 6,808,415 | B1 | 10/2004 | Montena | 439/584 |
| 6,824,415 | B2 | 11/2004 | Wlos | 439/348 |
| 6,835,095 | B2 | 12/2004 | Chen | 439/578 |
| 6,848,931 | B2 | 2/2005 | McMullen et al. | 439/350 |
| 6,848,939 | B2 | 2/2005 | Stirling | 439/578 |
| 6,848,941 | B2 | 2/2005 | Wlos et al. | 439/585 |
| 6,863,565 | B1 | 3/2005 | Kogan et al. | 439/580 |
| 6,893,290 | B2 | 5/2005 | Buenz et al. | 439/578 |
| 6,926,555 | B2 | 8/2005 | Nelson | 439/578 |
| 6,939,169 | B2 | 9/2005 | Islam et al. | 439/578 |
| 7,001,546 | B2 | 2/2006 | Dunk | 439/580 |
| 7,008,264 | B2 | 3/2006 | Wild | 439/578 |
| 7,059,162 | B1 | 6/2006 | Tarpill et al. | 72/112 |
| 7,077,700 | B2 | 7/2006 | Henningsen | 439/583 |
| 7,104,839 | B2 | 9/2006 | Henningsen | 439/578 |
| 7,121,883 | B1 | 10/2006 | Petersen et al. | 439/582 |
| 7,134,189 | B2 * | 11/2006 | Buenz et al. | 29/748 |
| 7,144,272 | B1 | 12/2006 | Burris et al. | 439/578 |
| 7,156,696 | B1 | 1/2007 | Montena | 439/584 |
| 7,163,420 | B2 | 1/2007 | Montena | 439/578 |
| 7,179,121 | B1 | 2/2007 | Burris et al. | 439/578 |
| 7,329,149 | B2 | 2/2008 | Montena | 439/584 |
| 7,335,059 | B2 | 2/2008 | Vaccaro | 439/578 |
| 7,381,089 | B2 | 6/2008 | Hosler, Sr. | 439/578 |
| 7,422,477 | B2 | 9/2008 | Eriksen | 439/578 |
| 7,435,135 | B2 | 10/2008 | Wlos | 439/584 |
| 7,448,906 | B1 | 11/2008 | Islam | 439/578 |
| 2005/0118865 | A1 | 6/2005 | Henningsen | 439/578 |
| 2006/0112549 | A1 | 6/2006 | Henningsen | 29/857 |
| 2007/0149047 | A1 | 6/2007 | Wild et al. | 439/578 |
| 2009/0053931 | A1 | 2/2009 | Islam | 439/578 |
| 2009/0186521 | A1 | 7/2009 | McMullen et al. | 439/578 |

OTHER PUBLICATIONS

Paynter, "Coaxial Connector Inner Contact Arrangement," Jul. 15, 2008, pp. 1-17.
Paynter, "Insertion Coupling Coaxial Connector," Nov. 3, 2008, pp. 1-24.
Paynter, "Low PIM Rotatable Connector," Jan. 29, 2009, pp. 1-17.
Islam, "Axial Compression Connector," Nov. 3, 2008, pp. 1-25.
Islam, "Flaring Coaxial Cable End Preparation Tool and Associated Methods", Nov. 24, 2008, pp. 1-32.
Islam, "Connector Including Compressible Ring for Coaxial Cable and Associated Methods," Nov. 24, 2008, pp. 1-30.
Islam, "Connector With Positive Stop and Compressible Ring for Coaxial Cable and Associated Methods," Nov. 24, 2008, pp. 1-25.
Islam, "Connector With Retaining Ring for Coaxial Cable and Associated Methods," Nov. 24, 2008, pp. 1-28.
Islam, "Connector Including Flexible Fingers and Associated Methods," Jan. 28, 2009, pp. 1-26.
Islam, "Inner Conductor Sealing Insulator for Coaxial Connector," Oct. 7, 2008, pp. 1-17.
Islam, "Inner Contact Supporting and Biasing Insulator," Jan. 29, 2009, pp. 1-16.

* cited by examiner

CONNECTOR WITH POSITIVE STOP FOR COAXIAL CABLE AND ASSOCIATED METHODS

FIELD OF THE INVENTION

The present invention relates to the field of connectors for cables, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

U.S. Pat. No. 5,795,188 to Harwath, for example, discloses a connector for a coaxial cable having a corrugated outer conductor. The connector includes a connector housing defining a radially outer ramp to contact the inside surface of a flared end portion of an outer conductor of the coaxial cable. A clamping ring is in the corrugation adjacent to the flared end portion of the outer conductor. The clamping ring presses the outer surface of the outer conductor against the radially outer ramp to provide electrical contact therebetween.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

U.S. Pat. No. 7,077,700 to Henningsen discloses a coaxial cable connector including a removable back nut, an outer body, and a center conductor supported within the outer body by a dielectric. An uncompressible clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is clamped between mating clamping surfaces formed on the clamp ring and the outer body.

Despite these advances in connector technology, a need remains for connectors that may facilitate easy installation and that may retain a good electrical contact with the coaxial cable under a variety of operating conditions.

SUMMARY OF THE INVENTION

In view of the foregoing background, it is therefore an object of the present invention to provide an easier to install connector for a coaxial cable that maintains a good electrical contact with the coaxial cable under a variety of operating conditions.

This and other objects, features, and advantages in accordance with the present invention are provided by a connector to be attached to a coaxial cable comprising an inner conductor, an outer conductor, and a dielectric therebetween. The outer conductor may be a smooth wall outer conductor or, alternatively, may be a corrugated outer conductor. The connector may comprise a connector housing defining a ramp to receive the outer conductor thereagainst and a back nut. A portion of the connector housing and the back nut may include respective portions defining a positive stop when fully engaged. The positive stop may allow the connector to be attached to the coaxial cable without a torque wrench or other torque limiting tool, as the positive stop indicates to the installer when to stop tightening the back nut and the connector housing together.

The connector may further comprise an electrically conductive compressible coil spring to compressibly clamp against the outer conductor opposite the ramp when the connector housing and back nut are engaged. This advantageously provides secure mechanical and electrical connections between the outer conductor and the connector housing. Furthermore, this maintains a sufficient clamping force on the outer conductor opposite the radially outer ramp during vibration of the connector or if the size and/or shape of the outer conductor changes due to thermal expansion or aluminum creep.

The electrically conductive compressible coil spring may have an axis coaxial with the connector housing. The connector housing may comprise a rearward portion threadingly received with a forward portion of the back nut. The connector may also include a center contact to be coupled to the inner conductor. An insulator member may be in the connector housing for carrying the center contact.

The connector housing may comprise an enlarged diameter tool engaging portion. The back nut may comprise a forward portion and the positive stop may defined by the enlarged diameter tool engaging portion and the forward portion of the back nut. Furthermore, at least one sealing ring may be positioned radially inward of and adjacent to the positive stop.

The back nut may have a spring cavity defined therein. The electrically conductive compressible coil spring may be positioned in the spring cavity. The insulator member may comprise a radially outer support portion to radially support the outer conductor opposite the compressible ring. This radial support portion supports the outer conductor radially outwardly as the electrically conductive compressible coil spring urges the outer conductor radially inwardly.

Further, the ramp may have a stair-stepped shape. This stair-stepped shape may present an increased friction surface to the outer conductor to help prevent unwanted movement of the outer conductor. This stair-stepped shape may also enhance the electrical contact with the outer conductor.

The insulator member may have a central opening defined therein to carry the inner conductor. Also, there may be an additional insulator member spaced apart from, and positioned rearwardly of, the insulator member in the connector housing that has a central opening defined therein to carry the center contact. The back nut may have a plurality of threads to threadingly receive the coaxial cable. Each of the plurality of threads may have a chamfered end and respective ones of the chamfered ends may be spaced apart from each other.

At least one sealing ring may be carried within the back nut. This sealing ring may seal the interior of the connector housing and the back nut from moisture and debris. The back nut may have a sealing ring cavity formed therein. The at least one sealing ring may be positioned within the sealing ring cavity so that the coaxial cable compresses the at least one sealing ring when the back nut is attached to the coaxial cable. The at least one sealing ring may comprise a radially inwardly extending forward end to seal against an exposed portion of the outer conductor of the coaxial cable. Additionally or alternatively, the at least one sealing ring comprises a radially inwardly extending forward end to seal against an exposed portion of a jacket of the outer conductor.

The outer conductor of the coaxial cable may comprise a corrugated outer conductor or a smooth outer conductor. Indeed, in some applications, the connector may accommodate either corrugated and smooth outer conductors. This advantageously allows a same connector to be used for multiple cable types.

A method aspect is directed to a method of making connector to be attached to a coaxial cable comprising an inner conductor, an outer conductor, and a dielectric therebetween. The method may comprise forming a connector housing having a ramp to receive the outer conductor thereagainst. Furthermore, the method may include forming a back nut have a forward portion to threadingly receive a rearward portion of the connector housing and to define a positive stop therewith when fully engaged with the connector housing. An electrically conductive compressible coil spring may be formed to be compressibly clamped against the outer conductor opposite the ramp when the connector housing and a back nut are engaged. Furthermore, the method may include forming an insulator member to be positioned in the connector housing for carrying a center contact to be coupled to the inner conductor.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
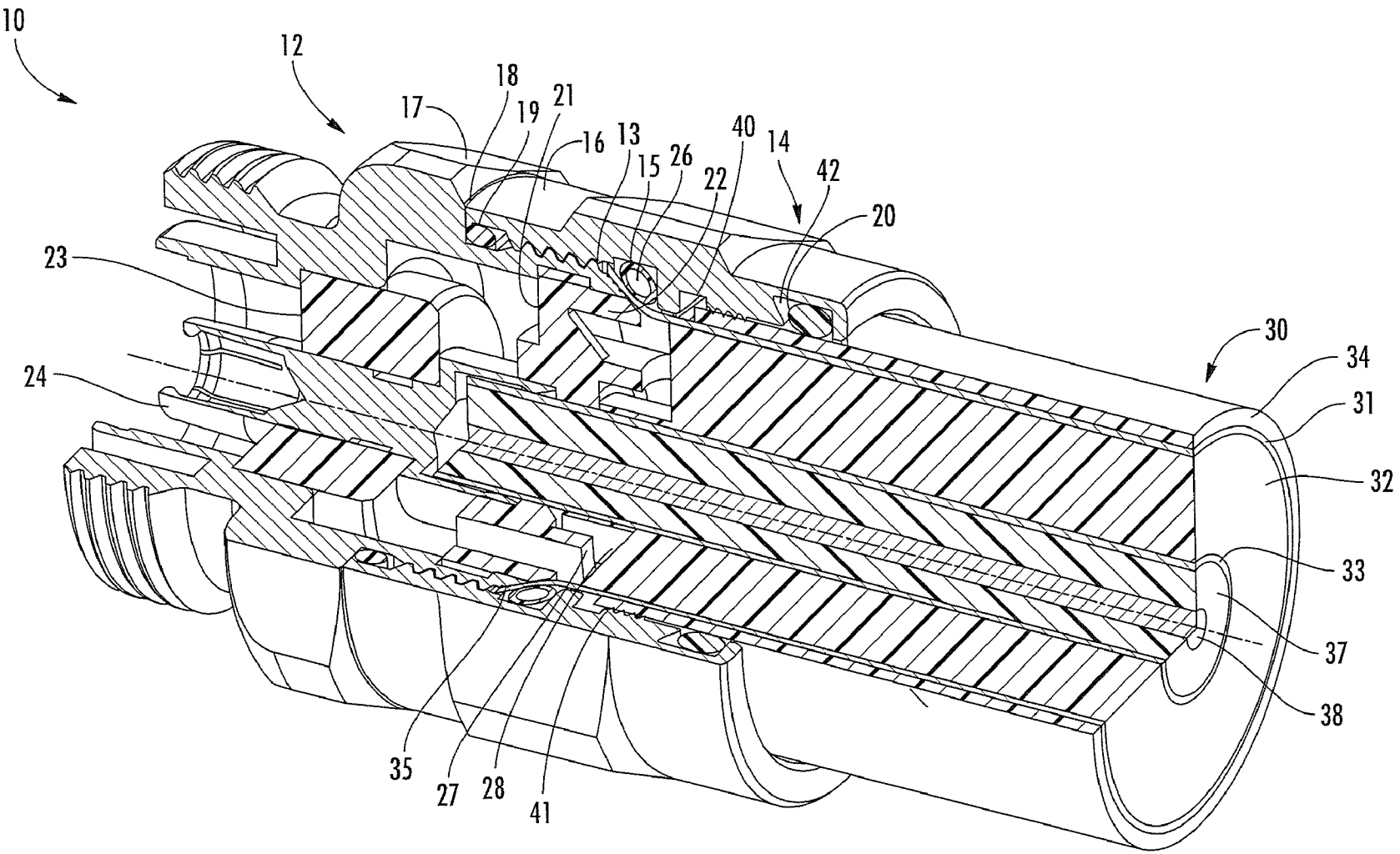
FIG. 1 is a perspective cutaway view of a connector installed on the end of a coaxial cable having a smooth outer conductor in accordance with the present invention.
Figure 2:
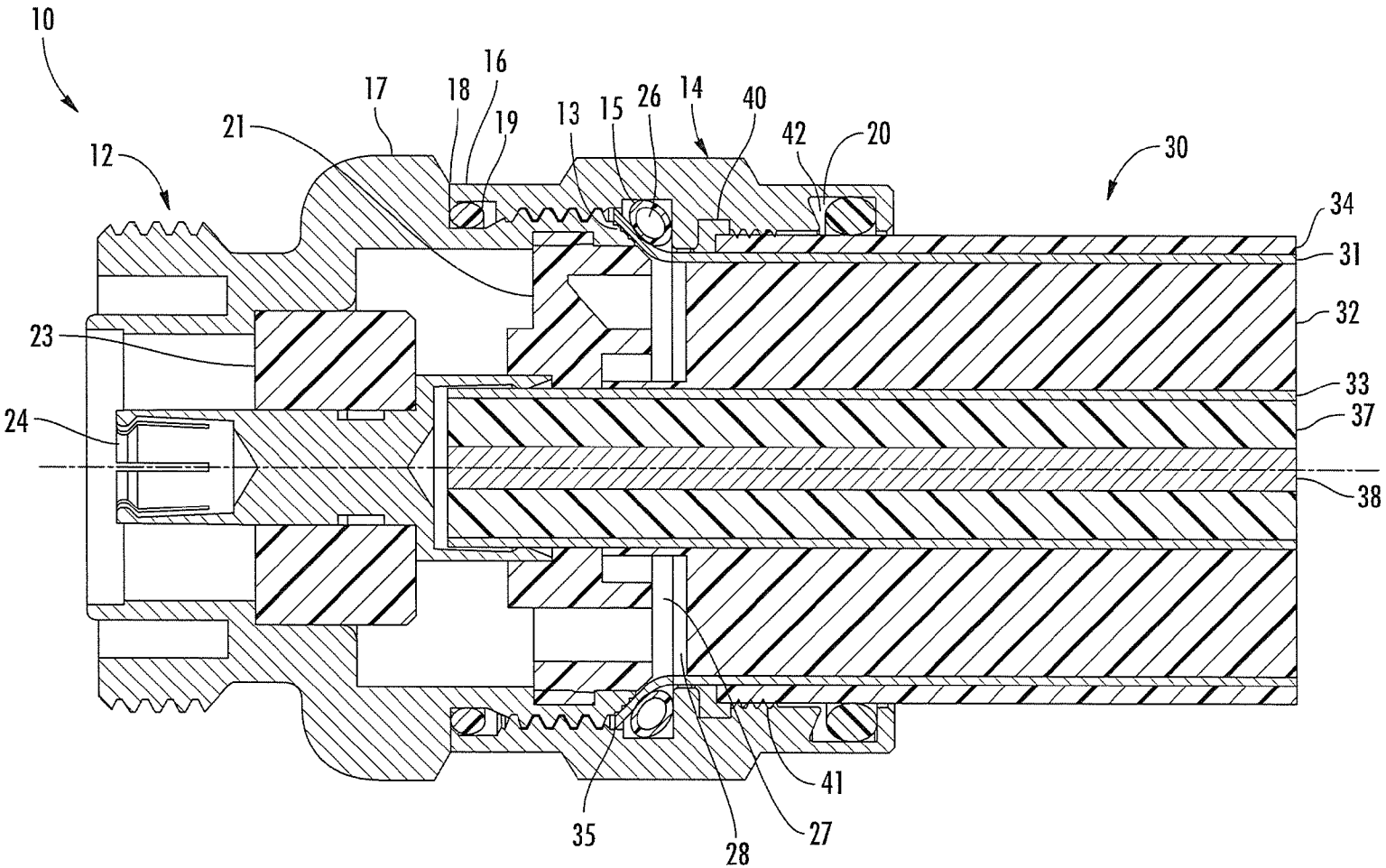
FIG. 2 is a longitudinal cross-sectional view of the connector of FIG. 1.
Figure 3:
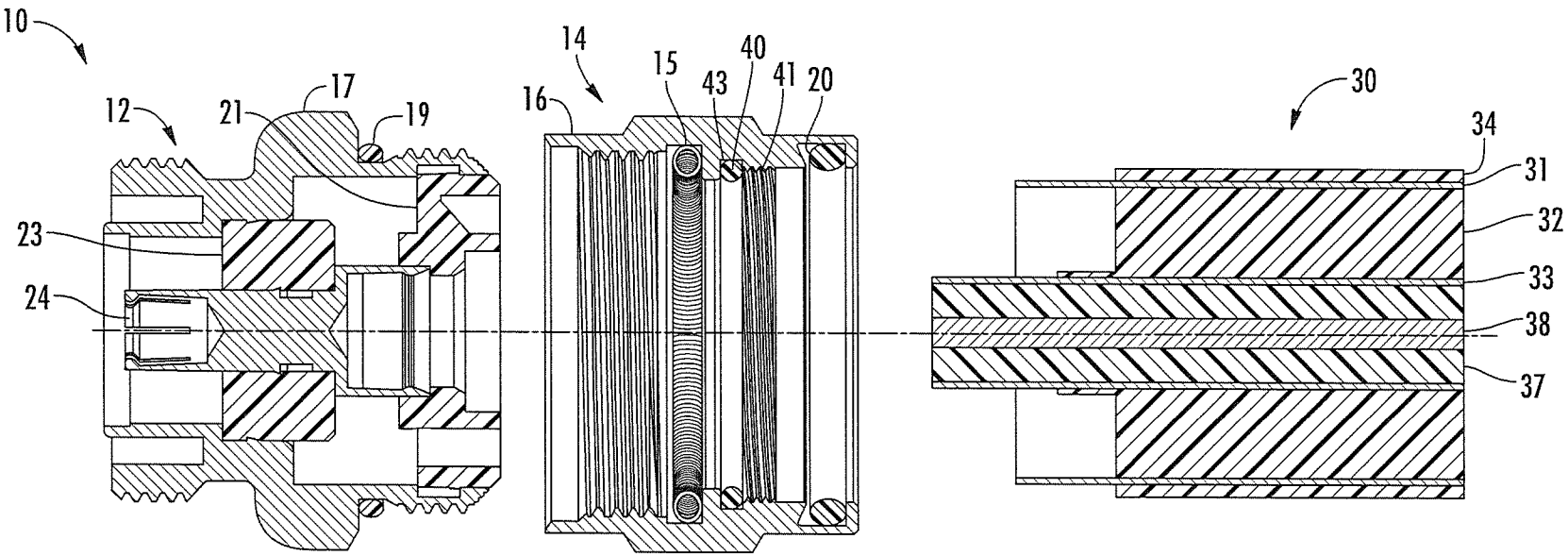
FIG. 3 is an exploded cross-sectional view of the connector of FIG. 1.

Referring initially to FIGS. 1-3, a connector 10 for a coaxial cable 30 is now described. The coaxial cable 30 comprises an inner conductor 33, an outer conductor 31, and a dielectric 32 therebetween. The inner conductor 33 is illustratively a tubular inner conductor with a dielectric core. The outer conductor 31 is illustratively a corrugated outer conductor with a flared end 35, but could be a smooth outer conductor in other embodiments. The dielectric 32 may be a foam dielectric or other dielectric as known to those skilled in the art.

The connector 10 includes an internally threaded back nut 12 to receive an externally threaded rearward end of a connector housing 12. A forward o-ring 19 and a rearward o-ring 20 are illustratively provided to seal respective forward and rearward interfaces adjacent the back nut 14 and may prevent moisture ingress. Of course, the o-rings 19, 20 may be gaskets instead of o-rings, as will be appreciated by one of skill in the art. Furthermore, a sealing ring 40 is positioned between the O-rings 19, 20. The sealing ring further helps in sealing both the jacket 34 and the outer conductor 31.

As shown in FIG. 3, the back nut 14 has a sealing ring pocket defined 43 therein. The sealing ring 40 is positioned in the sealing ring cavity 43 so that the coaxial cable 30 compresses the sealing ring both longitudinally and radially when the back nut 14 is installed on the coaxial cable. The sealing ring 40, as shown in the exploded view of FIG. 3, is uncompressed because the back nut 14 is not attached to the coaxial cable 30. When the back nut 14 is installed on the coaxial cable 30, as shown in FIGS. 1-2, the sealing ring 40 is compressed.

The connector housing 12 defines a ramp 13 to receive the outer conductor 31 thereagainst. The ramp 13 illustratively has a stair-stepped surface, although the skilled artisan will understand that other ramp surfaces may be used. (FIG. 4) For example, the ramp 13 may have a radiused concave shape.

The end of the coaxial cable 30 is prepared so that the inner conductor 33 extends longitudinally outwardly beyond the end of the outer conductor 31. In addition, portions of the dielectric 32 are removed in a stair-stepped fashion so that the inner surface of the outer conductor 31 is also exposed. The coaxial cable 30 illustratively includes an outer insulation jacket 34 stripped back a distance so that outer end portions of the outer conductor 31 are exposed. The outer conductor 31 is flared outwardly to define the flared end 35.

A portion of the connector housing 12 and a portion of the back nut 14 include respective portions defining a positive stop 18 when fully engaged. More particularly, the connector housing 12 comprises an enlarged diameter tool engaging portion 17 and the back nut 14 comprises a forward end 16. The positive stop 18 is defined by the abutting relationship between enlarged diameter tool engaging portion 17 and the forward end 16 of the back nut. The forward o-ring 19 is radially inward of and adjacent to the positive stop 18. The seal formed by the forward o-ring 19 is activated by threading the back nut 14 onto the jacket 34. The forward o-ring reduces the gap between the jacket 34 and the forward end 16 of the back nut. It should of course be understood that other variations of the positive stop 18 are possible. Indeed, the connector housing 12 may have a rear portion to engage with a shoulder of the back nut 14 to define the positive stop 18.

The positive stop 18 helps prevent overtightening of the engagement between the connector housing 12 and the back nut 14 that may generate compression and or shearing forces at potentially damaging levels. The positive stop 18 therefore facilitates easy installation of the connector 10 on the coaxial cable 30 by eliminating the need for a torque wrench or other torque limiting tool.

Figure 4:
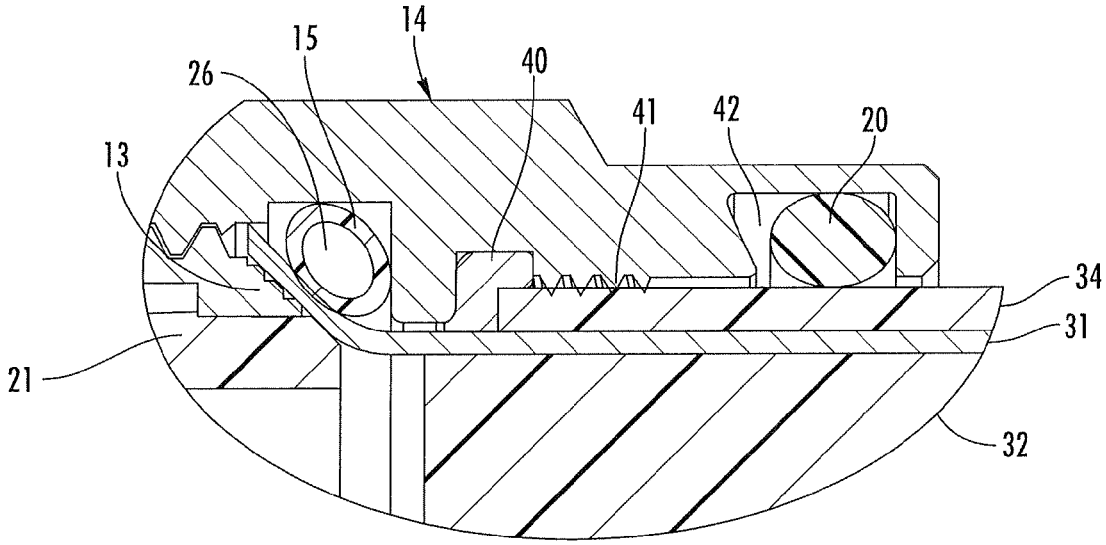
FIG. 4 is a greatly enlarged cross sectional view of the electrically conductive compressible coil spring of the connector of FIG. 1.

Referring additionally to FIG. 4, the back nut 14 illustratively has a spring cavity 26 to receive an electrically conductive compressible coil spring 15 therein. The electrically conductive compressible coil spring 15 compressibly clamps against the outer conductor 31 opposite the ramp 13 as the connector housing 12 and back nut 14 are engaged. The electrically conductive compressible coil spring 15 illustratively has an axis coaxial with that of the connector housing 12. Those skilled in the art will recognize that the electrically conductive compressible coil spring 15 may be a coil spring, garter spring, or stamped ring.

This clamping helps to provide an electrical connection between the outer conductor 31 and the ramp 13 by providing a constant contact pressure between the outer conductor and the ramp. By maintaining such a secure electrical connection, the intermodulation distortion of signals traveling through the coaxial cable 30 may be reduced.

The electrically conductive compressible coil spring 15 advantageously maintains a sufficient clamping force on the outer conductor 31 even if the outer conductor changes shape or size due to thermal expansion or aluminum creep, for example, whereas an arrangement of two wedging surfaces to clamp the outer conductor might lose clamping force and contact pressure if the outer conductor were to change shape or size. Furthermore, by maintaining a constant clamping force on the outer conductor 31, the electrically conductive compressible coil spring 15 allows the connector 10 to be used with both smooth wall outer conductor coaxial cables 30 corrugated outer conductor coaxial cables. In addition the electrically conductive compressible coil spring 15 allows the connector 10 to be used on a variety of coaxial cables with different thicknesses, and on a variety of coaxial cables with outer conductors having different thicknesses.

The insulator member 21 comprises a radially outer support portion 22 to radially support the outer conductor 31 opposite the electrically conductive compressible coil spring 15. This radial support supports the outer conductor 31 radially outwardly as the electrically conductive compressible coil spring 15 urges the outer conductor radially inwardly. Furthermore, the radially outer support portion 22 helps to reduce the chance of a loss of electrical contact between the outer conductor 31 and the ramp 13 due to flexing of the coaxial cable 30 or due to compression of the dielectric 32. It should be noted that the insulator member 21 may have a rigid structure.

Figure 5:
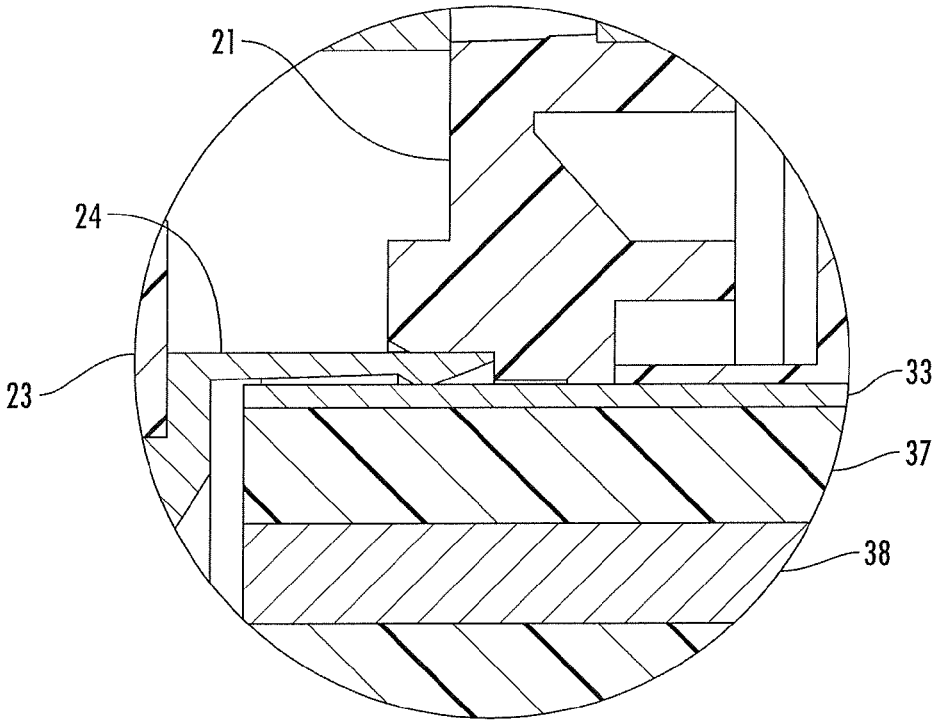
FIG. 5 is a greatly enlarged cross sectional view of the insulator member of FIG. 1.

A center contact 24 is supported in the connector housing 12 by an additional insulator member 23 and is electrically connected to the inner conductor 33. The insulator member 21 is also carries the inner conductor 33 of the cable to reduce or prevent movement to thereby reduce IMD (FIG. 5). Furthermore, the clamping provided by the electrically conductive compressible coil spring 15 reduces radial movement of the connector 10 about the coaxial cable 30. That is, the electrically conductive compressible coil spring 15 acts as an anti-rotational device, such as a lock washer, to clamp the coaxial cable 30 between the connector housing 12 and back nut 14 and bite into the outer conductor 31 to reduce or prevent rotation of the connector 10 about the coaxial cable 30.

The insulator member 21 illustratively includes a rearward portion 27 engaging the dielectric 32 of the coaxial cable 30. The illustrated insulator member 21 and additional insulator member 23 are each single monolithic units. This monolithic construction helps to reduce the number of connector components and thereby reduce the overall cost of the connector 10. Of course, the insulator member 21 and additional insulator member 23 may also be two-piece units in some applications.

Figure 8:
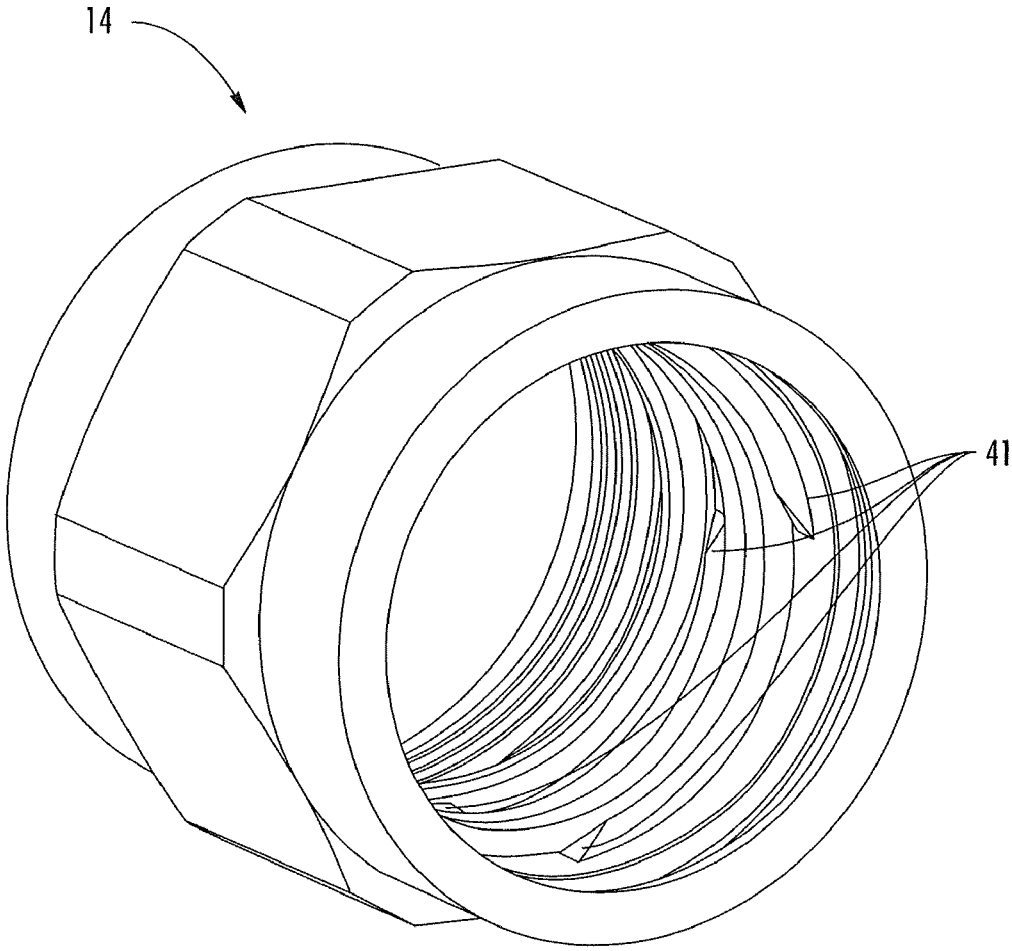
FIG. 8 is a perspective view of the back nut of the connector shown in FIG. 1.
Figure 9:
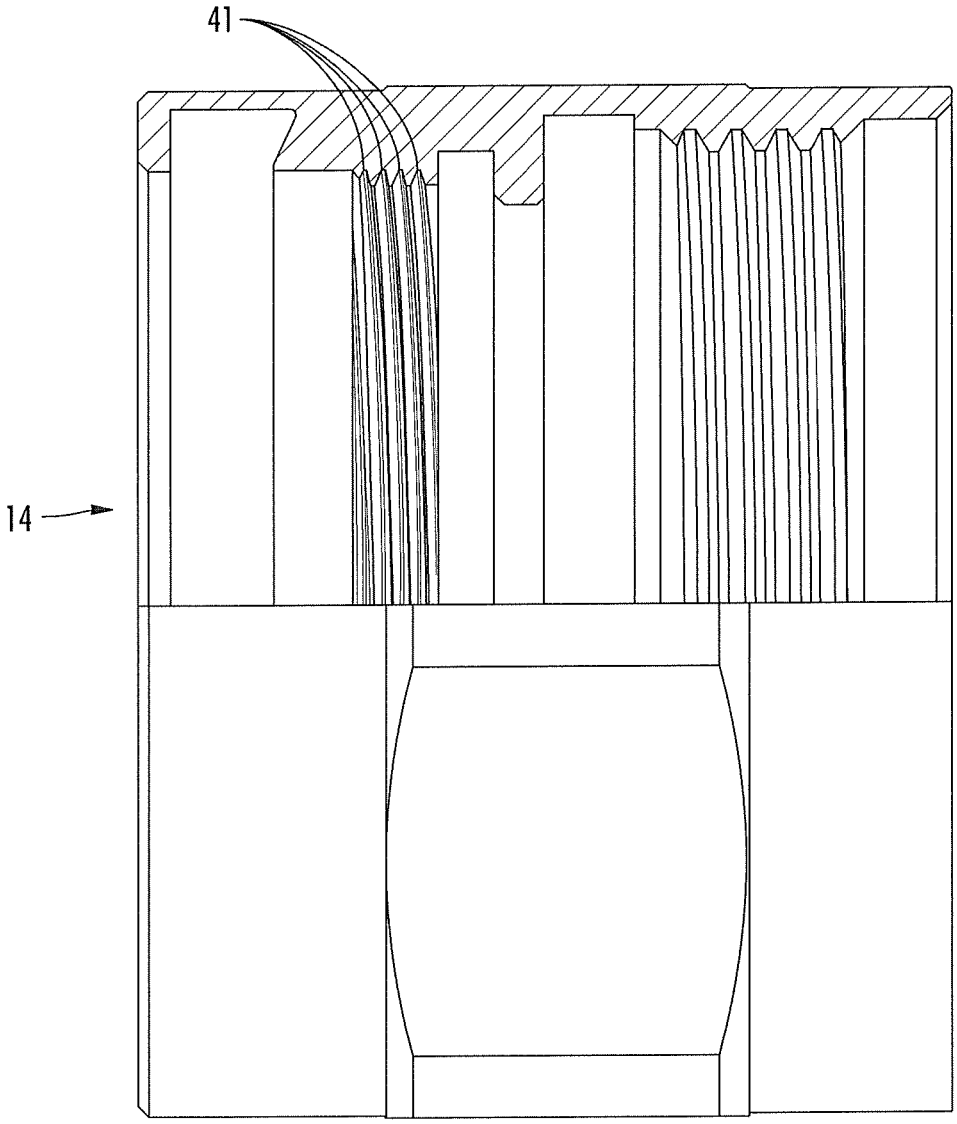
FIG. 9 is a side cutaway view of the back nut of the connector shown in FIG. 1.

As perhaps best shown in FIGS. 8-9, the back nut 14 has a plurality of (for example, three) starting threads 41 to threadingly receive the coaxial cable 30. These starting threads 41 assist a technician with threading the back nut 14 onto the coaxial cable 30 properly and evenly by aligning the longitudinal axis of the back nut with the longitudinal axis of the coaxial cable by balancing the back nut with a plurality of threads points on the jacket 34. When the back nut 14 is properly and evenly installed on the coaxial cable 30, intermodulation distortion (IMD) may be reduced. Further, it may be difficult to thread or install the connector housing 12 into the back nut 14 if the back nut 14 is misaligned on the coaxial cable 30. Furthermore, the starting threads 41 may reduce installation time by allowing the back nut 14 to be threaded into the coaxial cable 30 with a decreased amount of rotations as opposed to a back nut without the starting threads. As shown in FIG. 8, each of the starting threads 41 has a chamfered end. These chamfered ends are spaced apart from each other. Of course, those skilled in the art will recognize that the starting threads 41 need not have such chamfered ends in all embodiments.

Figure 6:
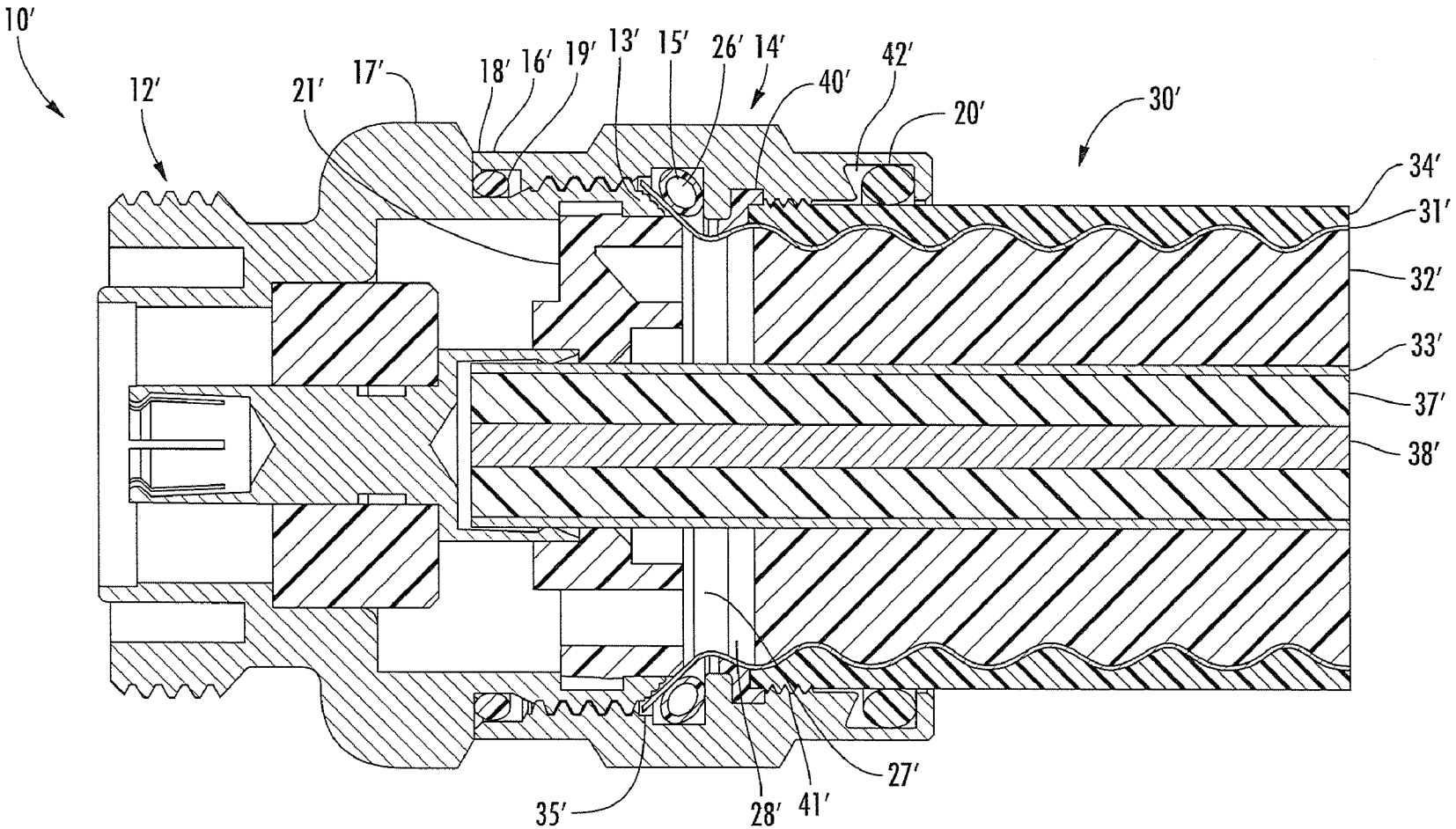
FIG. 6 is a longitudinal cross-sectional view of the connector of FIG. 1 installed on the end of a cable.

In another application shown in FIG. 6 the connector 10' is installed on a coaxial cable having a corrugated outer conductor 31.

Figure 7:
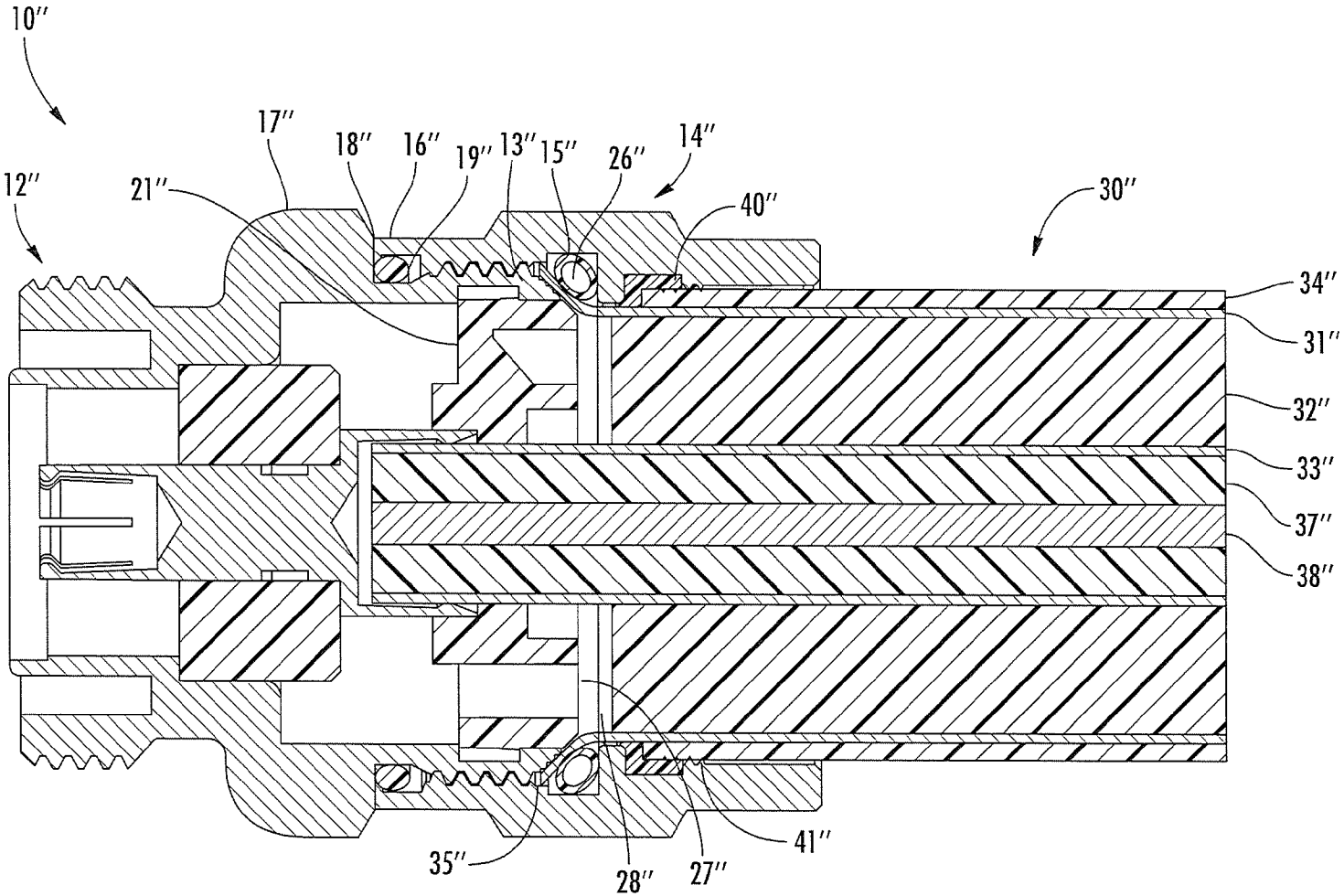
FIG. 7 is a longitudinal cross-sectional view of an alternative embodiment of a connector installed on the end of a coaxial cable having a smooth outer conductor in accordance with the present invention.

Those of skill in the art will appreciate that different configurations of the connector housing 12 and back nut 14 may be used. For example, in an embodiment of the connector 10" illustrated in FIG. 7, the back nut 14" lacks a rearward o-ring. Instead, the sealing ring 40" seals both the jacket 34" and the outer conductor 31". As explained above, the sealing ring 40" resides in a sealing ring pocket 43" defined in the back nut 14" and is compressed radially and longitudinally outwardly when the back nut is installed on the coaxial cable 30". Those other elements not specifically mentioned are indicated with prime notation and are similar to the elements described above with reference to FIG. 1. Accordingly, those other elements require no further description herein.

Referring again to FIG. 1, a method aspect is directed to a method of making connector 10 to be attached to a coaxial cable 30 comprising an inner conductor 33, an outer conductor 31, and a dielectric 32 therebetween. The method comprises forming a connector housing 12 having a ramp 13 to receive the outer conductor 31 thereagainst. Furthermore, the method includes forming a back nut 14 having a forward portion 16 to threadingly receive a rearward portion 36 of the connector housing and to define a positive stop 18 therewith.

Furthermore, the method includes forming an electrically conductive compressible coil spring 15 to be compressibly clamped against the outer conductor 31 opposite the ramp 13 when the connector housing 12 and a back nut 12 are engaged. An insulator member 21 is formed to be positioned in the connector housing 12 for carrying a center contact 24 to be coupled to the inner conductor 33. The insulator member 21 is also for carrying the inner conductor 33 of the cable to reduce or prevent movement thereby to reduce IMD.

Other details of such connectors 10 for coaxial cables 30 may be found in co-pending applications CONNECTOR INCLUDING COMPRESSIBLE RING FOR COAXIAL CABLE AND ASSOCIATED METHODS, FLARING COAXIAL CABLE END PREPARATION TOOL AND ASSOCIATED METHODS, CONNECTOR WITH POSITIVE STOP AND COMPRESSIBLE RING FOR COAXIAL CABLE AND ASSOCIATED METHODS, and CONNECTOR WITH RETAINING RING FOR COAXIAL CABLE AND ASSOCIATED METHODS, the entire disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A connector to be attached to a coaxial cable comprising an inner conductor, an outer conductor, and a dielectric therebetween, the connector comprising:

a connector housing defining a ramp to receive the outer conductor thereagainst;

a back nut;

said connector housing and said back nut including respective portions defining a positive stop when fully engaged;

an electrically conductive compressible coil spring to compressibly clamp against the outer conductor opposite the ramp;

said connector housing comprising a rearward portion threadingly received within a forward portion of said back nut;

a center contact to be coupled to the inner conductor; and at least one insulator member in said connector housing for carrying said center contact.

2. The connector of claim 1 wherein said connector housing comprises an enlarged diameter tool engaging portion; wherein said back nut comprises a forward end; and wherein the positive stop is defined by said enlarged diameter tool engaging portion and said forward end.

3. The connector of claim 2 wherein said back nut has a spring cavity defined therein; and wherein said electrically conductive compressible coil spring is positioned in the spring cavity.

4. The connector of claim 1 wherein said insulator member comprises a radially outer support portion to radially support the outer conductor opposite said compressible ring.

5. The connector of claim 1 wherein the ramp has a stair-stepped shape.

6. The connector of claim 1 wherein said at least one insulator member comprises a first insulator member having a central opening defined therein to carry said center contact.

7. The connector of claim 6 wherein said at least one insulator member further comprises a second insulator member longitudinally spaced apart from, and positioned forwardly of, said insulator member in the connector housing and also having a central opening defined therein to carry said center contact.

8. The connector of claim 1 wherein said back nut has a plurality of threads to threadingly receive the coaxial cable.

9. The connector of claim 1 wherein each of said plurality of threads has a chamfered end; and wherein respective ones of the chamfered ends are spaced apart from each other.

10. The connector of claim 1 further comprising at least one sealing ring carried within said back nut.

11. The connector of claim 10 wherein said at least one sealing ring comprises a radially inwardly extending forward end to seal against an exposed portion of the outer conductor of the coaxial cable.

12. The connector of claim 10 wherein the coaxial cable further comprises a jacket surrounding the outer conductor; and wherein said at least one sealing ring comprises a radially inwardly extending forward end to seal against an exposed portion of the jacket.

13. The connector of claim 10 wherein said back nut has a sealing ring cavity therein; and wherein said at least one sealing ring is positioned within the sealing ring cavity so that the coaxial cable compresses said at least one sealing ring when said back nut is attached to the coaxial cable.

14. The connector of claim 1 wherein the outer conductor of the coaxial cable comprises a corrugated outer conductor.

15. The connector of claim 1 wherein the outer conductor of the coaxial cable comprises a smooth outer conductor.

16. A connector to be attached to a coaxial cable comprising an inner conductor, an outer conductor, and a dielectric therebetween, the connector comprising:

a connector housing defining a ramp to receive the outer conductor thereagainst;

a back nut comprising a forward portion;

said connector housing comprising an enlarged diameter tool engaging portion cooperating with said forward portion of said back nut to define a positive stop when fully engaged;

an electrically conductive compressible coil spring to compressibly clamp against the outer conductor opposite said ramp;

said back nut further comprising a radially inner ledge to radially support a portion of the electrically conductive compressible coil spring;

said connector housing comprising a rearward portion threadingly received within a forward portion of said back nut;

a center contact to be coupled to the inner conductor; and an insulator member in said connector housing for carrying said center contact.

17. The connector of claim 16 wherein said back nut has a spring cavity defined therein; and wherein said electrically conductive compressible coil spring is positioned in the spring cavity.

18. The connector of claim 16 wherein said insulator member comprises a radially outer support portion to radially support the outer conductor opposite said compressible ring.

19. The connector of claim 16 further comprising an additional insulator member longitudinally spaced apart from, and positioned rearwardly of, said insulator member in the connector housing and having a central opening defined therein to carry the center contact.

20. A method of making connector to be attached to a coaxial cable comprising an inner conductor, an outer conductor, and a dielectric therebetween, the method comprising:

forming a connector housing having a ramp to receive the outer conductor thereagainst;

forming a back nut having a forward portion to threadingly receive a rearward portion of the connector housing and to define a positive stop therewith when fully engaged with the connector housing;

forming an electrically conductive compressible coil spring to be compressibly clamped against the outer conductor opposite the ramp; and forming an insulator member to be positioned in the connector housing for carrying a center contact to be coupled to the inner conductor.

21. The method of claim 20 wherein the ramp comprises a stair-stepped ramp.

22. The method of claim 20 wherein the back nut has a spring cavity therein; and wherein the electrically conductive compressible coil spring is to positioned in the spring cavity.

23. The method of claim 20 further comprising forming at least one sealing ring to be positioned radially inwardly of and adjacent to the positive stop.

24. The method of claim 20 wherein the back nut is formed to have a plurality of threads to threadingly receive the coaxial cable.

* * * * *

UNITED STATES PATENT AND TRADEMARK OFFICE

CERTIFICATE OF CORRECTION

PATENT NO. : 7,785,144 B1
APPLICATION NO. : 12/277103
DATED : August 31, 2010
INVENTOR(S) : Islam It is certified that error appears in the above-identified patent and that said Letters Patent is hereby corrected as shown below:

| | |
|---|---|
| Column 1, Line 36 | Delete: "make electrical"<br>Insert: --make an electrical-- |
| Column 2, Line 56 | Delete: "may defined"<br>Insert: --may be defined-- |
| Column 3, Line 34 | Delete: "making"<br>Insert: --making a-- |
| Column 3, Line 39 | Delete: "have"<br>Insert: --having-- |
| Column 5, Line 54 | Delete: "corrugated"<br>Insert: --and corrugated-- |
| Column 6, Line 7 | Delete: "is" |
| Column 6, Line 34 | Delete: "threads"<br>Insert: --thread-- |
| Column 6, Line 65 | Delete: "making"<br>Insert: --making a-- |
| Column 9, Line 3 | Delete: "making"<br>Insert: -- making a-- |
| Column 10, Line 8 | Delete: "to" |

Signed and Sealed this
Nineteenth Day of July, 2011

David J. Kappos

David J. Kappos
*Director of the United States Patent and Trademark Office*